US011519072B2

(12) United States Patent
Astorg et al.

(10) Patent No.: US 11,519,072 B2
(45) Date of Patent: Dec. 6, 2022

(54) SOL-GEL METHOD FOR PRODUCING AN ANTI-CORROSION COATING ON A METAL SUBSTRATE

(71) Applicants: ELECTRICITE DE FRANCE, Paris (FR); SORBONNE UNIVERSITE, Paris (FR); CENTRE NATIONAL DE LA RECHERCHE SCIENTIFIQUE-CNRS-, Paris (FR); COLLEGE DE FRANCE, Paris (FR)

(72) Inventors: Adele Astorg, Paris (FR); Xavier Crozes, Le Plessis Robinson (FR); Lionel Nicole, Brunoy (FR); Clement Sanchez, Bures (FR)

(73) Assignees: ELECTRICITE DE FRANCE, Paris (FR); SORBONNE UNIVERSITE, Paris (FR); CENTRE NATIONAL DE LA RECHERCHE SCIENTIFIQUE—CNRS—, Paris (FR); COLLEGE DE FRANCE, Paris (FR)

( * ) Notice: Subject to any disclaimer, the term of this patent is extended or adjusted under 35 U.S.C. 154(b) by 538 days.

(21) Appl. No.: 16/471,966

(22) PCT Filed: Dec. 20, 2017

(86) PCT No.: PCT/EP2017/083957
§ 371 (c)(1),
(2) Date: Jun. 20, 2019

(87) PCT Pub. No.: WO2018/115207
PCT Pub. Date: Jun. 28, 2018

(65) Prior Publication Data

US 2019/0338423 A1 Nov. 7, 2019

(30) Foreign Application Priority Data

Dec. 22, 2016 (FR) ..... 16 63250

(51) Int. Cl.
*C23C 18/12* (2006.01)
*C23C 22/00* (2006.01)

(52) U.S. Cl.
CPC ..... *C23C 18/1254* (2013.01); *C23C 18/1216* (2013.01); *C23C 18/1241* (2013.01); *C23C 18/1279* (2013.01)

(58) Field of Classification Search
CPC ..... C23C 2222/20
See application file for complete search history.

(56) References Cited

U.S. PATENT DOCUMENTS

2008/0111027 A1 5/2008 Blohowiak et al.
2013/0221352 A1 8/2013 Steiger et al.
(Continued)

FOREIGN PATENT DOCUMENTS

CN 103201409 A 7/2013
CN 103325859 B 8/2016
(Continued)

OTHER PUBLICATIONS

Office Action issued in related application KR 10-2019-7017984, dated Feb. 2, 2021, with English language translation, 14 pages.

*Primary Examiner* — Lois L Zheng
(74) *Attorney, Agent, or Firm* — Faegre Drinker Biddle & Reath LLP

(57) ABSTRACT

A sol-gel method for producing an anti-corrosion coating consisting of at least one layer of an oxide on a metal substrate. A non-aqueous solution of a precursor of the oxide is prepared and deposited on one surface at least of the metal substrate in order to cover said surface at least partially with a film comprising the precursor of the oxide. Hydrolysis-condensation of the precursor of the oxide is carried out by exposing the film to a humid atmosphere in order to form an oxide network in the film. Then, a treatment for stabilizing the film on the surface of the substrate is carried out,
(Continued)

followed by a heat treatment of the surface of the metal substrate in order to crystallize the network of oxide and form the anti-corrosion coating.

14 Claims, 5 Drawing Sheets

(56) References Cited

U.S. PATENT DOCUMENTS

| | | | | |
|---|---|---|---|---|
| 2016/0312364 | A1* | 10/2016 | Crozes | C23C 18/1241 |
| 2016/0348248 | A1 | 12/2016 | Fan et al. | |
| 2018/0022938 | A1* | 1/2018 | Ijeri | C23C 22/66 428/469 |

FOREIGN PATENT DOCUMENTS

| | | | | | |
|---|---|---|---|---|---|
| FR | 3 014 907 | A1 | | 6/2015 | |
| JP | 03-024275 | A | | 2/1991 | |
| JP | H05-247657 | A | | 9/1993 | |
| JP | H06-101067 | A | | 4/1994 | |
| JP | H06-157033 | A | | 6/1994 | |
| JP | H11-156214 | A | | 6/1999 | |
| JP | 2000-016812 | A | | 1/2000 | |
| JP | 2001-261338 | A | | 9/2001 | |
| JP | 2011-256452 | A | | 12/2011 | |
| WO | 95/16060 | A1 | | 6/1995 | |
| WO | WO 2015/087011 | | * | 6/2015 | C23C 18/12 |

* cited by examiner

SOL-GEL METHOD FOR PRODUCING AN ANTI-CORROSION COATING ON A METAL SUBSTRATE

CROSS-REFERENCE TO RELATED APPLICATIONS

This application is the U.S. national phase of the International Patent Application No. PCT/EP2017/083957 filed Dec. 20, 2017, which claims the benefit of French Application No. 16 63250 filed Dec. 22, 2016, the entire content of which is incorporated herein by reference.

FIELD

The disclosure relates to the field of protection against the corrosion of metal substrates. The disclosure can for example be implemented for producing anti-corrosion coatings in the primary or secondary fluid circuits of a nuclear power plant, or in the field of aeronautics or the protection of installations on the seacoast such as marine current turbines or wind turbines. More broadly, the disclosure relates to any field that requires protecting metals or metal alloys against generalized corrosion, pitting corrosion or stress corrosion.

BACKGROUND

Protecting metal substrates from corrosion intervenes in many fields. It can intervene in industries such as for example construction, civil engineering, transportation and can affect industrial installations such as thermal or nuclear power plants.

In the nuclear industry, the primary, secondary and tertiary thermal circuits are subject to corrosion by the fluid circulating in these circuits. The material that forms these circuits is generally a stainless steel alloy for the coating of the reactor vessel and pipes, or alloys with a nickel base for steam generators. Despite good resistance to corrosion, the primary circuit requires optimum resistance to corrosion. Indeed, the corrosion products can be activated under neutron flux, be redeposited in the circuit and increase the radiological risk in the installation. The tertiary circuit is open to the environment, and can give rise to undesirable pollution. The corrosion of condensers made of brass of this circuit can for example give rise to an undesirable discharge of copper. Using stainless steel as a replacement for brass can have an impact on the development of pathogenic microorganisms.

The stainless alloys of these installations are often protected by a passive oxide film that forms a protective film on the surface of the metal substrate. However, this film is able to be destabilized when the chemistry of the environment changes, and lead to generalized or localized corrosion of the substrate. Pitting corrosion, crevice corrosion, intergranular corrosion or stress corrosion can then cause cracks to propagate in the substrate.

It has been proposed to stabilize passive film by adding film-forming elements such as chromium, molybdenum, titanium, aluminum or silicon. This solution is however expensive and modifies the metallurgical structure and the mechanical properties of the material.

Another solution consists in controlling the chemistry of the corrosive medium in order to prevent a degradation of the passive film. This solution is however not practical and imposes a high operating constraint.

It has also been proposed to use an outer coating deposited on the metal substrate in order to protect it from corrosion.

As such it is possible to use a hybrid organic-inorganic coating that associates nanoparticles of oxides such as $Al_2O_3$, $TiO_2$, $SiO_2$ or clay, to which are grafted organic groups. However, this solution has the disadvantage of being sensitive to the temperature and cannot be used in power plants where the temperatures exceeding 200° C. would degrade the organic compounds.

It is also possible to use coatings that progressively release a corrosion inhibitor into the environment. This solution however has the disadvantage of modify the chemistry around the substrate which is not always compatible with the constraints of the industry, in particular in thermal or nuclear installations.

Another possibility consists in producing a coating in the form of nano-film of oxide on the metal substrate, chemically stable in the corrosive environment and resistant to the temperatures present in the industrial installations, such as for example the nano-films of $TiO_2$, $ZrO_2$, $Al_2O_3$, $CeO_2$.

French Patent Application No. FR 13 62541 proposes a sol-gel method for treating a metal substrate by the depositing of a film of metal oxide. Using a sol-gel method, also called "solution-gelation" method has the advantage of being able to be used with large sizes of substrate. It is moreover implemented at low temperature, is inexpensive to implement, and allows for the production of thin films with a thickness typically between about ten and a hundred nanometers and with a controlled composition.

In the sol-gel method of French Patent Application No. FR 13 62541, a colloidal suspension of oligomers of which the diameter is of a few nanometers is transformed during a hydrolysis-condensation process in the presence of water in order to form a viscous network called "gel". The solution contains a precursor of the metal oxide in the form of alkoxides $[M(OR)_z]_n$ where M is a metal of valency z, R is an organic compound and n refers to the possibility of having precursors in the form of polymers or oligomers (when n is different from 0). The solution furthermore contains a non-aqueous solvent, water and can contain additives such as reaction inhibitors or catalysts. The hydrolysis-condensation process is carried out in solution by adding liquid water, before the depositing of the solution on the substrate, preferably during a step of maturation that can last several hours under stirring.

This type of sol-gel method for depositing an anti-corrosion coating on a metal substrate however has the disadvantage of requiring a homogenization of the solution during the step of maturation, with the risk of seeing appear inhomogeneities in the network of oxides formed by hydrolysis-condensation. Furthermore, this step of maturation provides the hydrolyzed solution with a limited service life beyond which it can no longer be used for carrying out a deposit. The maturation consequently adds a time constraint in using the solution to carry out a deposit, which leads to an increase in the operating cost when unused solution has to be discarded or recycled.

A method for producing an anti-corrosion coating that provides a better control of the quality and of the homogeneity of the coating obtained is therefore sought.

SUMMARY

In order to respond to the problems mentioned hereinabove, this disclosure propose a sol-gel method for producing an anti-corrosion coating consisting of at least one layer of an oxide on a metal substrate, with the method successively comprising:

/a/ Preparing a non-aqueous solution of a precursor of the oxide;

/b/ Depositing the non-aqueous solution on one surface at least of the metal substrate in order to cover said surface of the metal substrate at least partially with a film comprising the precursor of the oxide; and /c/ Carrying out a hydrolysis-condensation of the precursor of the oxide by exposing the film to a humid atmosphere in order to form an oxide network in the film;

/d/ Carrying out a treatment for stabilizing the film on the surface of the substrate;

/e/ Carrying out a heat treatment of the surface of the metal substrate in order to crystallize the network of oxide and form the anti-corrosion coating.

The sol-gel method of this disclosure allows for a finer and more precise control and of the hydrolysis-condensation process, with the latter being carried out in situ directly on the metal substrate after the depositing of the non-aqueous solution. This method makes it possible in particular to substantially increase the duration of use of the solution which is maintained in non-hydrolyzed form, with the hydrolysis being carried out only after the depositing of the solution on the sample.

Indeed, putting into contact with a humid atmosphere of the film comprising the precursor of the oxide provides a more homogeneous distribution of the moisture, which diffuses through a thin film to the metal substrate, preventing a local accumulation of water that can create a heterogeneous hydrolysis-condensation. This approach differs substantially from that involving a step of maturation as proposed in French Patent Application No. FR 13 62541. Indeed, when the hydrolysis is initiated by adding water in the liquid solution, a local accumulation of water can cause a heterogeneous hydrolysis condensation leading to an oxide network of inhomogeneous density. The approach proposed in this disclosure ensures better homogeneity for the oxide network, and therefore higher quality in the anti-corrosion coating produced.

Furthermore, using a humid atmosphere makes it possible to more finely control the unfolding of the hydrolysis-condensation. Parameters such as the moisture content and the duration of exposure of the film to the humid atmosphere can influence the unfolding of this chemical reaction. The putting into contact with a humid atmosphere furthermore makes it possible to overcome the disadvantages linked to the differences in reactivity of the components present in the solution. Indeed, precursors do not all react with the same reaction kinetics in solution. In the case of a maturation by adding water in solution, these differences in kinetics cannot be controlled, while exposing a thin film to a humid atmosphere, with a thickness of about a hundred nanometers, makes it possible to adjust the moisture content and the duration of exposure according to the reactivity of the precursor.

The approach of the disclosure, by initiating the hydrolysis-condensation directly in situ by putting into contact with a humid atmosphere, offers in particular the advantage of eliminating the step of maturation, which reduces the duration of implementation of the method by several hours.

The disclosure further allows for greater control on the properties of the anti-corrosion coating produced by providing an intermediate step of treatment for stabilizing the film that comprises the oxide network. This treatment for stabilizing makes it possible to remove any organic material that may be present in the film, and can also be used to reduce the porosity of the film, in the case of an ultraviolet treatment in particular. The presence of this intermediate step can in particular prevent the appearance of cracks or crazes during the later phase of heat treatment of the film, by consolidation of the film.

According to an embodiment, the steps /b/ to /d/ can be repeated in order to deposit more than one layer on the metal substrate.

By repeating the steps /b/ to /d/, it is possible to deposit several layers or one or several oxides in order to offer better protection against corrosion. Using a stack of several layers of oxide can in particular guarantee better protection against pitting corrosion. Furthermore, a stack of several layers can also eliminate defects such as cracks or gaps in the lower coatings.

According to an embodiment, the treatment for stabilizing can comprise exposing the film to a flow of gas brought to a temperature greater than an ambient temperature and less than 200° C.

By heating the film at these temperatures, the organic material that may be present in the film can be evaporated, and this regardless of the geometry of the metal substrate on which the film is deposited.

According to an embodiment, the treatment for stabilizing can include exposing the film to ultraviolet radiation.

Exposing the film to ultraviolet radiation makes it possible to break down any organic compounds that may be present in the film, such as for example complexing agents, alcoholates or surfactants, by means of the photocatalytic properties of the oxide precursor used, such as for example titanium oxide. Furthermore, controlling the irradiance and the spectrum of the radiation used makes it possible to reduce the porosity of the film, in particular when this step is implemented although the condensation of the oxide precursor is not yet completed. A typical irradiance of 225 $mW/cm^2$ with radiation comprising UVa (with a wavelength between 315 nm and 400 nm typically) and UVb (with a wavelength between 280 nm and 315 nm typically) is particularly suitable for reducing the porosity of the film. Furthermore, the decomposition of organic compounds under ultraviolet radiation is amplified under humid atmosphere.

According to an embodiment, the treatment for stabilizing can be chosen from a treatment of the film assisted by microwaves and a treatment of the film by induction at a temperature greater than an ambient temperature and less than 200° C.

Using microwaves makes it possible to effectively evaporate any organic material that may be present in the film, for any geometry of metal substrates on which the film is deposited. Moreover, microwaves also favor the condensation and the crystallization of the oxides.

According to an embodiment, the precursor of the oxide can be chosen from a precursor of titanium, a precursor of zirconium, a precursor of chromium, a precursor of yttrium, a precursor of cerium and a precursor of aluminum.

In particular, the precursor of the oxide can be chosen from: titanium ethoxide, titanium n-propoxide, titanium s-butoxide, titanium n-butoxide, titanium t-butoxide, titanium isobutoxide, titanium isopropoxide, tetrabutyl orthotitanate, tetra-tert-butyl orthotitanate, poly(dibutyltitanate), zirconium n-propoxide, zirconium n-butoxide, zirconium t-butoxide, zirconium ethoxide, zirconium 2-methoxymethyl-2-propoxide, zirconium 2-methyl-2-butoxide, zirconium isopropoxide, yttrium isopropoxide, yttrium n-butoxide, titanium methacrylate triisopropoxide, titanium diisopropoxide bis(tetramethylheptanedionate), titanium 2,4-pentanedionate, diisopropoxy-bis(ethylacetoacetato)titanate, titanium di-n-butoxide (bis-2,4-pentanedionate), titanium 2-ethylhexoxide, titanium oxide bis(acetylacetonate), bis(2,2,6,6-tetramethyl-3,5-heptanedionato)oxotitane, titanium bis(ammonium lactato)dihydroxide, zirconium bis(diethyl citrato)dipropoxide, zirconyl propionate, chromium acetate, cerium t-butoxide, cerium methoxyethoxide, aluminum s-butoxide, aluminum n-butoxide, aluminum t-butoxide, yttrium isopropoxide, yttrium butoxide, yttrium acetylacetonate, yttrium 2-methoxyethoxide, aluminum isopropoxide, aluminum ethoxide, aluminum tri-sec-butoxide, aluminum tert-butoxide, cerium isopropoxide.

These compounds are particularly suitable for an application to primary and tertiary circuits of nuclear or thermal power plants, as well as in aeronautics or installations on the seacoast such as wind turbines or marine current turbines.

According to an embodiment, the solution of the precursor of the oxide can include for one mole of the precursor of the oxide, 0 to 2 moles of complexing agent and 10 to 50 moles of ethanol.

Such a composition is very particular suited to the production of anti-corrosion coatings of a thickness between 50 nm and 150 nm. The control of composition of the solution is a parameter than can be adjusted for the thickness. Indeed, the more ethanol content there is, the thinner the thickness of the coating obtained is, since for the same quantity of solution deposited, there will be fewer molecules of precursor of the oxide. The quantity of complexing agents present in the solution makes it possible to modulate the reactivity of the various constituents of the solution. In particular, these complexing agents make it possible to more finely control the hydrolysis-condensation process during the depositing, and, to render the solution more stable over time and more homogeneous. Furthermore, the presence of complexing agents also makes it possible to substantially modify the microporosity of the coating, in particular the quantity of pores of a diameter less than 2 nm.

According to an embodiment, the solution of the precursor of the oxide can furthermore include for one mole of the precursor of the oxide up to 0.2 moles of a surfactant.

The presence and the relative quantity of surfactants in the solution make it possible to adjust the porosity of the coating. The more surfactants there are in the solution, the more the porosity of the coating increases. The quantity of surfactant indicated for one mole of the precursor of the oxide makes it possible to obtain a porosity that typically represents 40% to 50% by volume of the coating. This proportion can then be reduced by means of a treatment for stabilizing by applying ultra-violet radiation to the film. The appearance of pores in the film can contribute to making the anti-corrosion coating more resistant mechanically, in particular by making it more flexible which decreases the risk of the appearance of cracks due to the differences in thermal expansion between the metal substrate and the anti-corrosion coating. Furthermore, the presence of pores also makes it possible to more effectively confine the corrosion products and to reduce the migration of metal elements that form the substrate.

According to an embodiment, the step /b/ can be implemented by a technique chosen from: a dip-withdraw of the surface in the solution, the withdraw being carried out at a speed between 0.5 mm/s and 20 mm/s; a spraying of the solution onto the surface with a controlled spray flow rate and a controlled relative displacement speed of a sprayer with respect to the surface; an evaporation of the solution in an enclosure containing the surface and under controlled temperature and pressure.

The dip-withdraw (also called dip-coating), is a simple technique, suitable for metal substrates of simple shape such as planar elements. The thickness of the coating can be controlled by means of the withdraw speed of the metal substrate from the solution. According to the disclosure, the depositing of the non-aqueous solution with a method of the dip-withdraw type is carried out via draining, obeying a regime called "Landau Levich" rather than by capillarity. In this mode of depositing, the higher the withdraw speed is, the thicker the film obtained is.

The spraying of the solution on the surface of the metal substrate is more suited for metal substrates of complex geometrical shape, such as bent cylindrical ducts for example. The displacement speed of the sprayer, as well as the flow rate make it possible to adjust the thickness of the coating thus obtained.

The evaporation of the solution in an enclosure under controlled pressure and temperature is an advantageous alternative to spraying for depositing the solution on metal substrates of complex geometrical shape.

According to an embodiment, the step /b/ can be carried out by putting the surface into contact with a spongy element impregnated with the solution and diffusing the solution via capillarity on the surface.

The diffusion of the solution by the spongy element makes it possible to deposit the solution on the surface.

According to an embodiment, the step /b/ can be carried out by the putting into contact of the surface with a predetermined volume of solution confined at least partially by a sealed membrane, the sealed membrane being able to slide via translation along the surface, with a controlled displacement of the sealed membrane allowing for the formation of a controlled thickness of film on the surface.

Such a way of depositing the solution on the metal substrate offers the advantage of allowing for a particularly fine control of the quantity of solution deposited, as well as to best hug the surface of the metal substrate. The thickness of the film deposited then substantially depends on the translation speed of the sealed membrane. Furthermore, this technique for depositing reduces the quantity of solution required for depositing a film of precursor on the surface.

In particular, as the surface is an inside surface of a cylindrical substrate, the sealed membrane can be mobile in translation along an axis of the cylindrical substrate.

According to an embodiment, the steps /b/ to /e/ are implemented on a production line carrying out a relative displacement of the metal substrate with respect to animated modules arranged to carry out the depositing of the solution on the surface, the exposing of the film to a humid atmosphere, the exposing of the film to a treatment for stabilizing and the exposing of the film to a heat treatment.

The various steps of the method for producing the anti-corrosion coating can be carried out on the same production line, wherein the various actions described hereinabove are carried out by modules brought to the metal substrate by the production line. In such a production line, each module can carry out an action on the metal substrate in accordance with the steps described hereinabove.

According to an embodiment, the heat treatment is carried out at a temperature between 300° C. and 500° C.

These temperatures can be applied for about 30 minutes in order to crystallize the metal oxide to conclude the synthesis of the anti-corrosion coating.

The disclosure also relates to a metal substrate comprising an anti-corrosion coating obtained by implementing the method described hereinabove.

BRIEF DESCRIPTION OF THE DRAWINGS

The method object of the disclosure shall be better understood when reading the following description of embodiments presented for the purposes of information, and in no way limiting, and the observation of the drawings hereinafter wherein.

For reasons of clarity, the dimensions of the various elements shown in these figures are not necessarily in proportion with their actual dimensions. In the figures, identical references correspond to identical elements.

DETAILED DESCRIPTION

This disclosure proposes a method for producing an anti-corrosion coating consisting of at least one layer of an oxide on a metal substrate. A possible application of the disclosure is the protection of ducts of primary, secondary and tertiary circuits of thermal or nuclear power plants. In this particular context, an optimum protection is sought in order to prevent any degradation following corrosion that can increase the radiological risk or the environmental impact.

Another application resides in the protection of installations subjected to a corrosive environment, such as motors in the aeronautical industry, installations on the seacoast (wind turbines, marine current turbines, subjected to humid and chlorinated environments) for example.

The disclosure consists of a method that is simple to implement, which can be applied on large surfaces of metal substrate of any shape. Furthermore, the quality of the coating obtained makes it possible to improve by a factor 100 to 1000 the protection against corrosion of a metal substrate, extending by as much the service life of the metal substrate.

Figure 1:
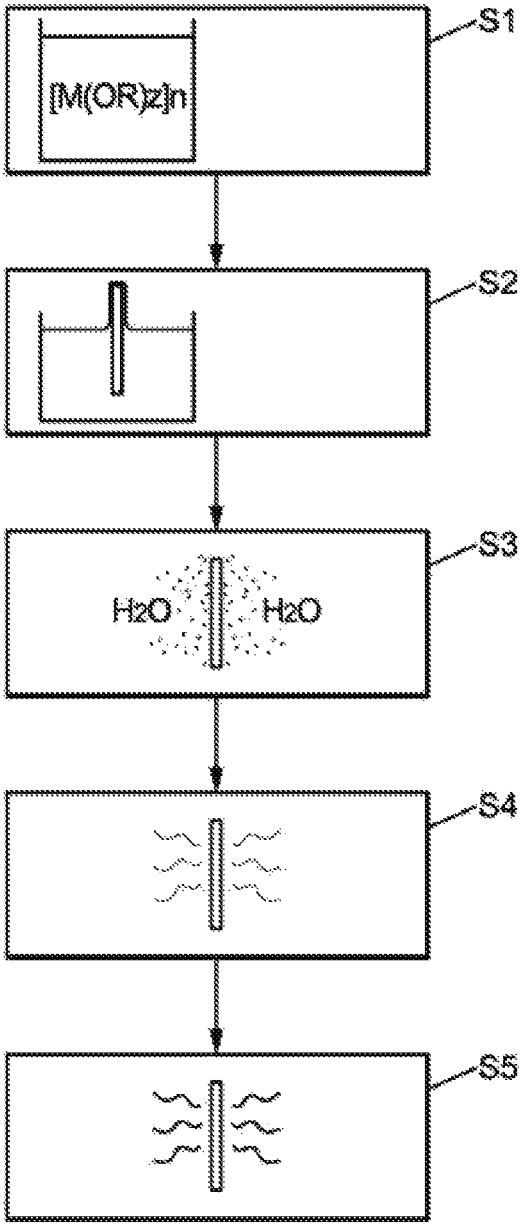
FIG. 1 is a flowchart showing five steps of the method for producing an anti-corrosion coating according to an embodiment.

FIG. 1 shows a flowchart that illustrates five steps of the method of the disclosure. This method is a sol-gel method that implements a first step S1 or preparing the sol-gel solution comprising a precursor of an oxide intended to form a coating on the metal substrate, a second step S2 of depositing the solution on a surface of the metal substrate in order to form a film of the precursor of the oxide, a third step S3 of initiating the hydrolysis-condensation by exposing the film to a humid atmosphere, for the purpose of creating an oxide network in the film. Then, a fourth step S4 of treatment for stabilizing aims to evaporate any organic component that may be present in the film, and to favor the condensation reactions that also make it possible to eliminate organic compounds. Finally, a step S5 corresponding to a thermal treatment of crystallization of the oxide network in order to form the anti-corrosion coating.

In a first step S1, a non-aqueous solution containing a precursor of the oxide is prepared. The precursor of the oxide is typically an oxide precursor of a transition metal of the alkoxide type of general formula $[M(OR)_z]_n$, where M is a metal of valency z, R is an organic compound. It is also possible to produce a composition that comprises several different oxide precursors, for example a mixture comprising a zirconium oxide precursor and a titanium oxide precursor.

The oxide precursor can typically be a precursor of titanium oxide or of zirconium oxide, which are metals that are particularly suited for use as a coating in nuclear installations. Zirconium oxide furthermore has the advantage of having a high coefficient of expansion, which naturally protects it from the appearance of cracks during the crystallization of the oxide network on metal substrates, which is carried out at a temperature between 300° C. and 500° C.

Other oxide precursors can be used as chromium or yttrium precursors. Yttrium can be used to stabilize the zirconium in the cubic phase in particular.

The group R is generally an alkyl group preferably comprising 1 to 4 carbon atoms such as a methyl, ethyl, n-propyl, i-propyl, n-butyl, s-butyl or t-butyl group.

In particular, the precursor can for example be chosen from the following compounds: titanium ethoxide $Ti(OC_2H_5)_4$, titanium propoxide $Ti(OC_3H_7)_4$, titanium isopropoxide $Ti[OCH(CH_3)_2]_4$, titanium butoxide $Ti(OCH_2CH_2CH_2CH_3)_4$, zirconium butoxide $Zr(OC_4H_9)_4$, zirconium propoxide $Zr(OCH_2CH_2CH_3)_4$, chromium acetylacetonate $Cr(C_5H_7O_2)_3$, yttrium butoxide $Y(OC_4H_9)_3$, yttrium isopropoxide $Y(OCH(CH_3)_2)_3$.

Furthermore, the precursor can be chosen from: titanium isobutoxide, poly(dibutyltitanate), zirconium ethoxide, zirconium 2-methoxymethyl-2-propoxide, zirconium 2-methyl-2-butoxide, zirconium isopropoxide.

The non-aqueous solution typically comprises a mixture in which for one mole of metal oxide precursor 10 to 50 moles of ethanol (non-aqueous solvent) are added and advantageously 0 to 2 moles of complexing agent.

The complexing agent is an additive that makes it possible to stabilize the precursor in the solution, in that the alkoxides are very reactive, which is detrimental to the quality of the oxide network obtained during the hydrolysis-condensation of the solution.

In the presence of a complexing agent, the metal oxide precursor has for general chemical formula $L_x[M(OR)_z]_{n-x}$, where L is a monodentate or polydentate ligand such as carboxylic acid in $C_{1-18}$ such as acetic acid, a β-dicetone, preferably in $C_{5-20}$, such as acetoacetone or dibenzoylmethane, a β-cetoester preferably in $C_{5-20}$ such as methyl acetoacetate, a β-cetoamide, preferably in $C_{5-20}$ such as an N-methylacetoacetamide, an α or β-hydroxiacid preferably in $C_{3-20}$ such as lactic acid or salicylic acid, an amino acid such as alanine or a polyamine such as diethylenetriamine (DETA).

The compounds that incorporate a ligand can in particular be chosen from: titanium methacrylate triisopropoxide, titanium diisopropoxide bis(tetramethylheptanedionate), titanium 2,4-pentanedionate, diispropoxy-bis(ethylacetoacetato)titanate, titanium di-n-butoxide (bis-2,4-pentanedionate), titanium 2-ethylhexoxide, titanium oxide bis(acetylacetonate), bis(2,2,6,6-tetramethyl-3,5-heptanedionato)oxotitane, titanium bis(ammonium lactato)dihydroxide, zirconium bis(diethyl citrato)dipropoxide, zirconyl propionate, chromium acetate.

It is suitable to note that the presence of complexing agents acts not only to stabilize the solution, but also makes it possible to cause a micro-porosity to appear in the oxide precursor film, with pores of a size typically less than about 2 nm.

The non-aqueous solution can in particular further contain a surfactant element, used to modify the porosity of the film of metal oxide obtained. The surfactant is present in the solution in proportions such that for one mole of the precursor of the oxide there is up to 0.2 mole of the surfactant.

The surfactant is typically chosen from non-ionic amphiphilic surfactants. These can be amphiphilic molecules or macromolecules such as polymers.

The molecular non-ionic amphiphilic surfactants can for example be ethoxylated linear alcohols in $C_{12-22}$, comprising from 2 to 30 ethylene oxide units, or esters of fatty acids comprising from 12 to 22 carbon atoms, and sorbitane. For example, the surfactants available under the name of Brij®, Span® and Tween® can be used.

The polymeric non-ionic amphiphilic surfactants can be any amphiphilic polymer that has both a hydrophilic nature and a hydrophobic nature. By way of example, these surfactants can be chosen from fluorinated copolymers such as $CH_3—[CH_2—CH_2—CH_2—CH_2—O]_n—CO—R_1$ with $R_1=C_4F_9$ or $C_8F_{17}$, with the block copolymers comprising two blocks, three blocks of the A-B-A or A-B-C type or four blocks.

Among the surfactants that are particular suited to this disclosure, the following compounds can be retained: copolymers with a poly((meth)acrylic acid) base, copolymers with a polydiene base, copolymers with a hydrogenated diene base, copolymers with a poly(propylene oxide) base, copolymers with a poly(ethylene oxide) base, copolymers with a polyisobutylene base, copolymers with a polystyrene base, copolymers with a poly(2-vinyl-naphthalene) base, copolymers with a poly(vinyl pyrrolidone) base, and block copolymers formed from chains of poly(alkylene oxide), with each block being formed from a chain of poly(alkylene oxide), with the alkylene comprising a different number of carbon atoms according to each chain.

In order to guarantee the presence of both hydrophilic and hydrophobic groups, one of the two blocks can comprise a chain of poly(alkylene oxide) of a hydrophilic nature while the other block can comprise a chain of poly(alkylene oxide) of hydrophobic nature. For a tri-block copolymer, two of the blocks can be of a hydrophilic nature while the other block, located between the two hydrophilic blocks, can be of a hydrophobic nature. Preferably, in the case of a tri-block copolymer, the chain of poly(alkylene oxide) of a hydrophilic nature are chains of poly(ethylene oxide) noted as $(POE)_u$ and $(POE)_w$ and the chains of poly(alkylene oxide) of hydrophobic nature are chains of poly(propylene oxide) noted as (POP)v or chains of poly(butylene oxide), or mixed chains in which each chain is a mixture of several monomers of alkylene oxides. In the case of a tri-block copolymer, it is possible to use a compound of formula $(POE)_u$-$(POP)_v$-$(POE)_w$ with $5<u<106$, $33<v<70$ and $5<w<106$. Commercialized compounds such as Pluronic® P123 (u=w=20 and v=70) or Pluronic® F127 (u=w=106 and v=70) can be favored.

The molar proportion of surfactant in the non-aqueous solution makes it possible to control the quantity of pores in the film of oxide precursor. Typically, adding surfactant in proportions such that for one mole of the precursor of the oxide there is up to 0.2 mole of the surfactant, leads to a porosity that can reach up to 50% by volume in the anti-corrosion coating, for an average pore size of 2 nm to 10 nm thick.

The presence of complexing agents and of surfactants can also contribute to increasing the thickness of the anti-corrosion coating while rendering it more porous.

The non-aqueous solution 1 can furthermore also comprise nanoparticles of titanium oxide or of zirconium oxide. These nanoparticles can be used as a seed crystal in order to favor the crystallization of the anti-corrosion coating during the step of heat treatment of the latter. Adding nanoparticles can also contribute to densifying the anti-corrosion coating and limiting the formation of cracks.

The second step S2 consists in depositing the non-aqueous solution on one surface at least of the metal substrate in order to form a film comprising the precursor of the oxide on this metal substrate. This step can be implemented in different ways, as disclosed in particular in FIGS. 2*a*, 2*b*, 3 and 4.

Figure 2A:
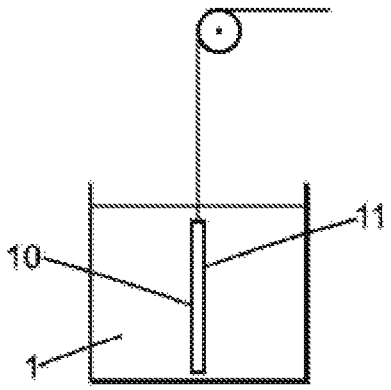
FIGS. 2*a* and 2*b* diagrammatically show a method of the dip-withdraw type of a metal substrate in a non-aqueous solution for depositing a film of a precursor of oxides on a surface of the substrate.
Figure 2B:
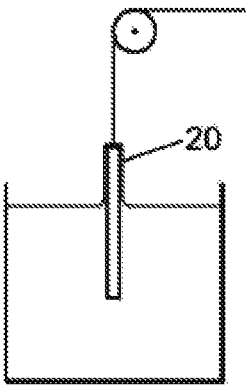

As indicated in FIG. 2*a*, a means for depositing the non-aqueous solution 1 on the surface 11 of the metal substrate 10 consists in carrying out a dip-withdraw (or dip-coating). In FIG. 2*a*, this step is carried out by plunging the metal substrate into the solution, then by removing the metal substrate from the solution, as shown in FIG. 2*b*. The thickness of the film comprising the precursor of the oxide depends in particular on the speed of the step of withdraw of FIG. 2*b*. Typically, in order to obtain films that have a thickness between 50 nm and 150 nm it is suitable to provide a withdraw speed between 0.5 mm/s and 20 mm/s. The dip-withdraw at these speeds is carried out by draining, not by capillarity. Thus, the higher the withdraw speed is, the thicker the film obtained is.

Another parameter than influences the thickness of the film obtained is the molar proportion in ethanol in the non-aqueous solution 1. Indeed, the more ethanol there is in the solution, the less precursor of the oxide there is per volume unit in the solution and the thinner the deposited film is.

Although FIGS. 2*a* and 2*b* show a dip-withdraw wherein the solution is maintained in a fixed position while the substrate is displaced in the solution, an alternative configuration that allows for a relative movement of the substrate in relation to the solution can also be implemented. The non-aqueous solution 1 can for example be displaced a first time until it coats the surface 11 of the metal substrate 10 then again displaced in order to release the metal substrate 10 of the non-aqueous solution 1, at a controlled speed.

Dip-withdraw is a method for depositing the solution on metal substrates of simple geometrical shape. However, more complex surfaces can benefit from more suitable methods such as spraying.

Spraying can be carried out in an alternative manner to the means of a sprayer mobile in relation to the metal substrate 10, of which the displacement speed and the ejected flow rate can be controlled in order to obtain a desired thickness of film 20.

Figure 3:
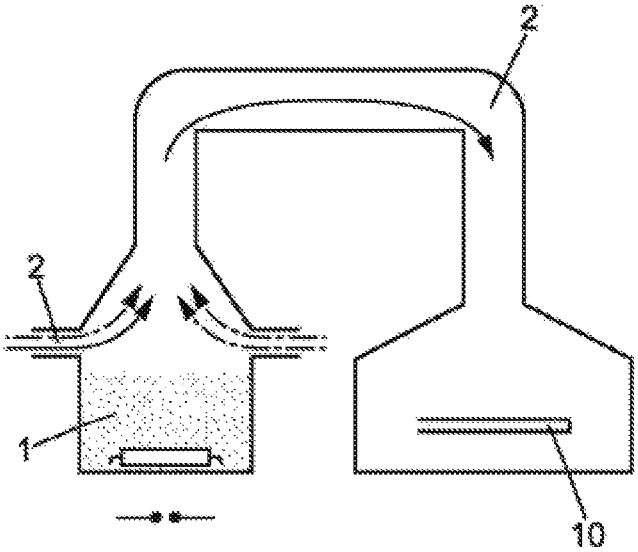
FIG. 3 diagrammatically shows a method for depositing the non-aqueous solution on the surface of the metal substrate by evaporation of the solution in an enclosure under controlled temperature and pressure.

FIG. 3 diagrammatically shows an example of a depositing of the non-aqueous solution 1 on the metal substrate 10 by evaporation of the solution in an enclosure containing the surface 11 and under controlled temperature and pressure. A carrier gas inlet 2 can contribute to conveying the solution and bringing it on the surface 11 of the metal substrate 10.

Figure 4:
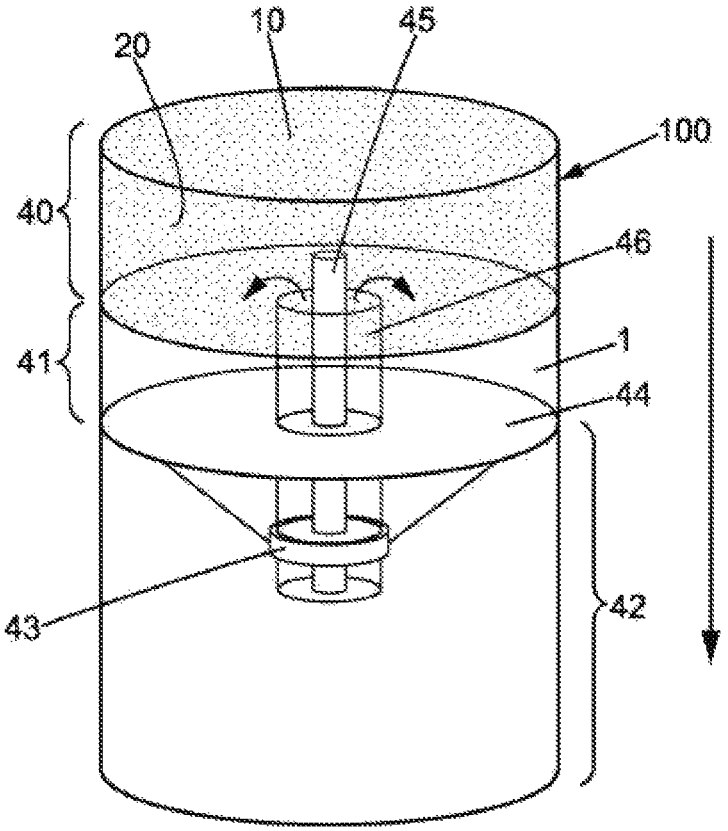
FIG. 4 diagrammatically shows the depositing of a non-aqueous solution of an oxide precursor on the inside surface of a cylindrical metal substrate by means of a membrane mobile in translation along the axis of the substrate.

According to another alternative that is particularly suited for a fine control of the thickness of the film 20 deposited on the metal substrate 10, it is possible to use a sealed membrane mobile in relation to the metal substrate as shown in FIG. 4.

FIG. 4 shows a cylindrical tank 100 comprising the metal substrate 20 as a cylindrical pipe. A sealed membrane 44 is fastened to an axis 45 of the cylindrical tank 100. A section 412 located above the membrane comprises a predefined volume of non-aqueous solution 1. The membrane 44 slides in translation along the axis 45 by maintaining a sealed contact with the walls of the metal substrate 10. The displacement of the sealed membrane 44 can in particular be provided by a traction ring 43 connected to the sealed membrane 44. The mass of this traction ring 43, as well as the volume of solution in the section 41 are parameters that make it possible to control the thickness of the film 20 deposited onto the metal substrate 10. The section 40 located above the section 41 is devoid of non-aqueous solution 1 but is already coated with the film 20. The section 42 located under the section 41 will be treated by the depositing of a film 20 when the sealed membrane 44 will be displaced to the level thereof.

An excess of non-aqueous solution 1 can be removed by openings provided in a central element 46 of which the dimensions are adapted to the maintaining of a predetermined volume of non-aqueous solution above the membrane 44.

Of course, using the displacement of a sealed membrane can be carried out for other geometries of the metal substrate 10, non-cylindrical, in which case the arrangement of the various elements described hereinabove can be adapted.

Another possibility for carrying out the depositing of the non-aqueous solution 1 on the surface 11 of the metal substrate 10 consists in using a spongy element impregnated with the non-aqueous solution 1 and diffusing while depositing the solution via capillarity on the surface 11.

A third step S3 of the method for producing an anti-corrosion coating consists in initiating the hydrolysis of the oxide precursor in the film 20 by exposing the film to water in gaseous form present in a humid atmosphere. An originality of the disclosure resides in the fact that this step S3, that makes it possible to increase the viscosity of the film 20 and form an oxide network in the film 20, is carried out after the film 20 has been deposited on the surface 11 of the metal substrate 10 in the step S2. Thus, the diffusion of the water in gaseous form prevents the local appearance of a large quantity of water that can produce a heterogeneous oxide network during the hydrolysis and the condensation that follows. The disclosure also eliminates recourse to a step of maturation in the non-aqueous solution, which is a long step of the methods of prior art. Moreover, initializing the hydrolysis via the gaseous route under a humid atmosphere makes it possible to offset the high reactivity of the oxide precursors by exposing them progressively and in a controlled manner to the moisture that is diffused through the thicknesses of the film 20. Furthermore, initiating the hydrolysis via exposure to a humid atmosphere is particularly effective due to the thicknesses of the film 20 that intervene in the method, of about a hundred nanometers, which facilitates the permeation of the water through the film 20.

It is suitable to note that the moisture content of the atmosphere can be controlled, and is advantageously between 20% and 80%. A higher level of humidity can lead to the formation of condensation on the film 20, which is not desired. A range of moisture content corresponding to the ambient humidity, typically between 40% and 70% is preferred.

The duration of the exposure to this humid atmosphere can typically be between 30 seconds, in particular for high levels of humidity, and 5 minutes, in particular for low moisture content.

The temperature during the step S3 is a parameter than can influence the kinetics of the hydrolysis-condensation. A temperature between 15° C. and 35° C. is preferred.

In the step S4 of FIG. 1, the film 20 that comprises the oxide network is subjected to a treatment for stabilizing that makes it possible to favor the condensation reactions that lead to an elimination of any organic component that remains in the film 20, and to prevent the appearance of cracks in the film during the later step of heat treatment S5.

The treatment for stabilizing of the step S4 can be carried out in different ways. For example, this treatment can be carried out by means of a simple exposure at a temperature greater than the ambient temperature, and advantageously less than 200° C., in an oven. Such an approach is suitable in particular for a treatment for homogeneous stabilizing in the case of metal substrates 10 of complex shape, such as for example bent pipes of a length that can reach 10 m.

Another approach consists in circulating a gas brought to a temperature greater than the ambient temperature, and advantageously less than 200° C. around the metal substrate 10.

According to another alternative, this stabilization of the film in order to consolidate the inorganic portion of the oxide network can be carried out by application of microwaves or by induction, at a temperature higher than the ambient temperature and less than 200° C.

According to another alternative, the consolidation of the film can be carried out by applying ultraviolet radiation. This solution has the advantage of furthermore allowing for a reduction in the porosity of the film, and therefore to densify the film 20 that comprises the oxide network. A duration of exposure between 30 seconds and 10 minutes to radiation with a wavelength between 280 nm and 400 nm (referred to as UVa and UVb radiation) with an irradiance of about 225 $mW/cm^2$ is particularly effective for stabilizing a film 20 of a thickness of about 100 nm.

The step S4 can be implemented at least partially although the step S3 is still being carried out.

Figure 5:
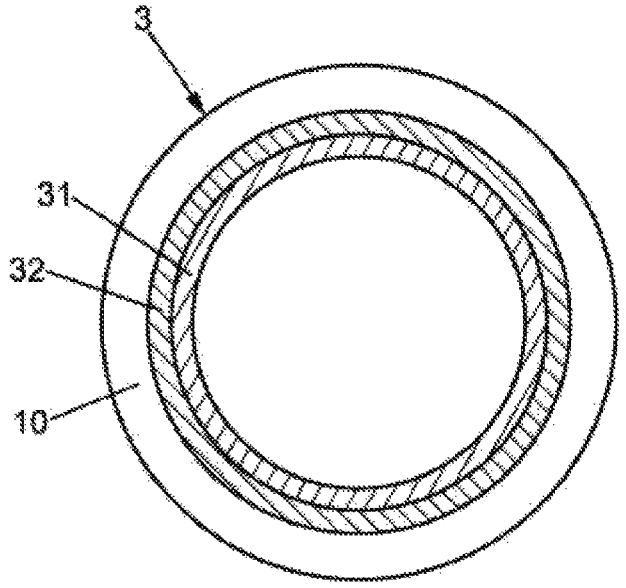
FIG. 5 diagrammatically shows a cylindrical metal substrate of the fluid circuit pipe type comprising an anti-corrosion coating on the inside surface thereof.

If more than one layer of protection has to be carried out, which is particularly advantageous in order to ensure good protection against pitting corrosion, it is possible to repeat the preceding steps on an existing coating. Furthermore, the method can even be repeated entirely (steps S1 to S5) during the depositing of each layer of coating. It is in particular possible to deposit several types of transition metal oxides that are different from one layer to another. FIG. 5 diagrammatically shows the section of a tube 3 of a fluidic circuit as a top view. The metal substrate 10 is covered on an inside surface of the tube 3 by two layers 31, 32 of different metal oxides. It is also possible to provide only a single layer for the anti-corrosion coating, which can be beneficial in order to prevent an excessive thickness for the anti-corrosion coating, and reduce the time and cost required for the total treatment of the substrate.

The step S5 consists in applying to the film 20 comprising the stabilized oxide network a heat treatment at a temperature typically between 300° C. and 500° C. This step is carried out preferably under a controlled atmosphere in order to prevent an oxidation of the substrate which disturbs the crystallinity of the coating. Thanks to this step the oxide network of the film 20 is crystallized in order to form the final anti-corrosion coating.

The method described hereinabove eliminates recourse to a long step of maturation of the non-aqueous solution 1, thanks to a hydrolysis-condensation in the vapor phase under a humid atmosphere. The disclosure can in particular be carried out on an industrial production line, such as that shown diagrammatically in FIG. 6.

Figure 6:
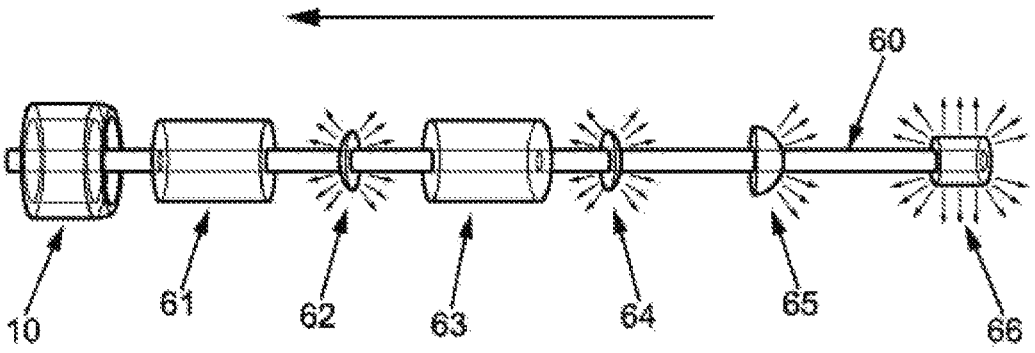
FIG. 6 diagrammatically shows a production line that scrolls modules that apply a method for producing an anti-corrosion coating on a metal substrate.

FIG. 6 proposes to place the metal substrate 10 in a fixed position, and to scroll the modules animated by a line 60 in the direction of the metal substrate 10. Thus, a first module 61 can for example be used to polish the surface 11 in order to prepare it for treatment. This preparation can be a mechanical stripping, a mechanical polishing or chemical stripping for example. A module 62 can then proceed with a cleaning of the polished surface 11, for example via rinsing. The module 63 carries out the depositing of the sol-gel solution by one of the methods described hereinabove for example. In FIG. 6, this depositing is carried out by a spongy element. A module 64 exposes the film 20 of the surface 11 to a humid atmosphere. The module 65 proceeds with the treatment for stabilizing (for example via exposure to ultraviolet radiation), then the module 66 carries out the treatment for crystallizing the anti-corrosion coating.

In the example of FIG. 6, the line 60 can be used to transport the various modules to the metal substrate 10, and can also include inlets for water, electricity and non-aqueous solution for example, in order to eliminate the various modules.

As an alternative, it is also possible to provide a displacement of the metal substrate 10 along a line 60 that comprises fixed modules.

The metal substrate provided with the anti-corrosion coating obtained thanks to the method described hereinabove has a resistance to corrosion 100 to 1000 greater than a metal substrate devoid of such a coating.

In particular, the corrosion current of a metal substrate comprising the anti-corrosion coating is less by at least a factor of 10 than a corrosion current of a metal substrate that does not comprise any anti-corrosion coating.

Figure 7A:
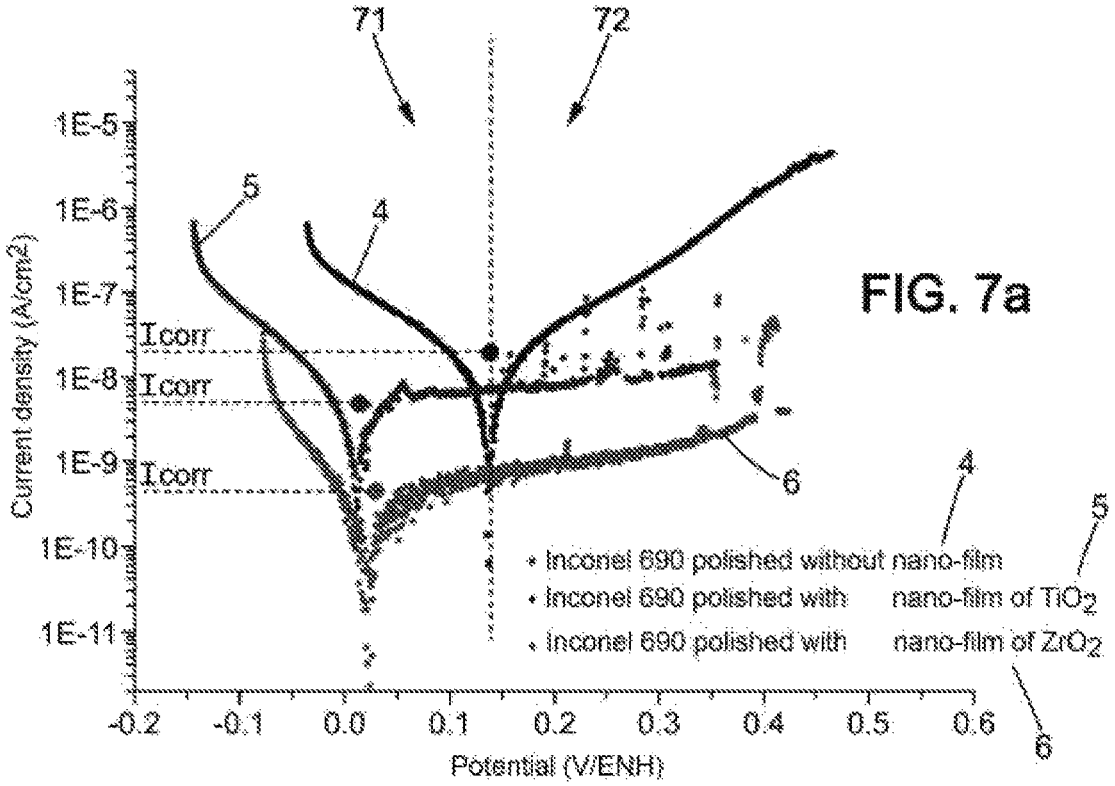
FIGS. 7*a* and 7*b* are graphs that respectively show the results of the electrochemical measurements at ambient temperature in a corrosive environment rich in chloride ions in the form of polarization curves (FIG. 7*a*) and in the form of a Bode diagram (FIG. 7*b*), for a substrate without coating, a substrate comprising a titanium oxide coating and a substrate comprising a zirconium oxide coating.

Comparative measurements were taken on a metal substrate of inconel 690, without anti-corrosion coating and with an anti-corrosion coating in $TiO_2$ and in $ZrO_2$, in the presence of a corrosive environment comprising chloride ions. FIG. 7*a* shows polarization curves for these three samples in a solution containing NaCl at a concentration of 0.05 mol/L. In FIG. 7*a* a cathodic Tafel region can be seen on the left portion of the figure and an anodic Tafel region on the right portion of the figure. The Tafel straight-line method makes it possible to determine the corrosion current density, indicated for each sample in FIG. 7*a* by the name $I_{corr}$. These curves reveal a corrosion current density and a corrosion potential that are clearly lower in the presence of anti-corrosion coating, which confirms the effectiveness of the method described hereinabove. In particular, the corrosion current density is 10 to 100 times smaller in the presence of a titanium oxide and zirconium oxide coating.

Figure 7B:
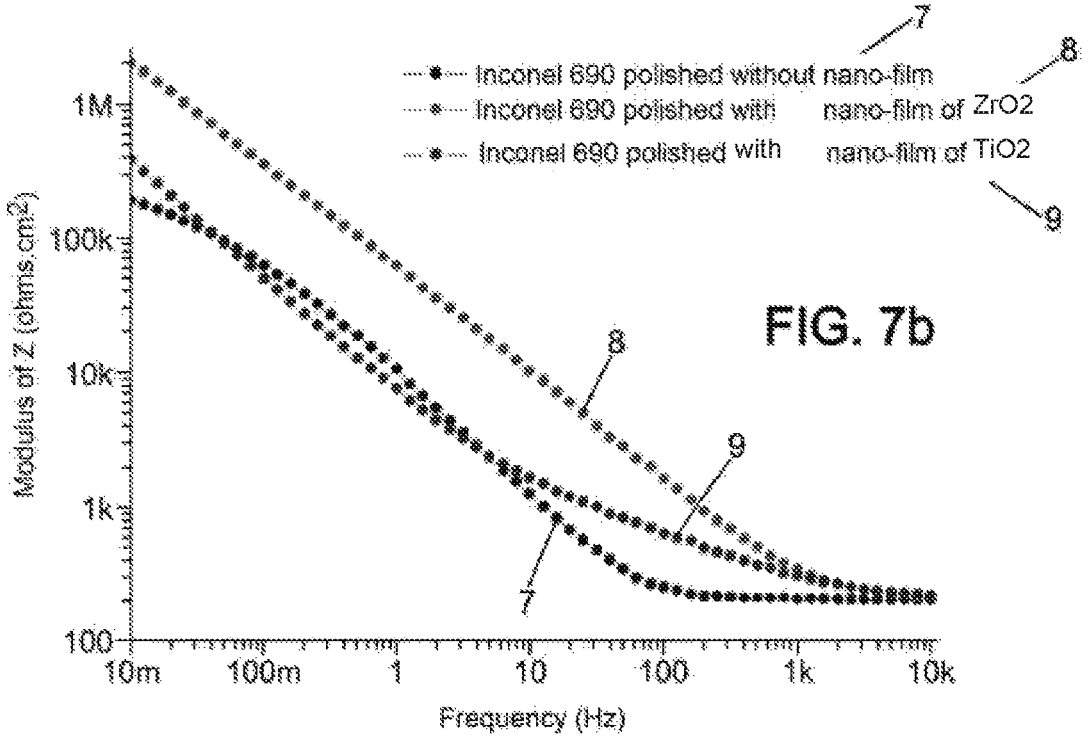

FIG. 7*b* shows impedance spectroscopy measurements taken on these same samples. The effectiveness of the coating with respect to corrosion is revealed in particular by an increase in the impedance modulus Z at low frequencies.

Other measurements, not shown, confirm the effectiveness of using several superposed layers of coating in order to reduce pitting corrosion. Additional tests carried out in an acidic medium confirm the results of FIGS. 7*a* and 7*b*.

The invention claimed is:

1. A sol-gel method for producing an anti-corrosion coating consisting of at least one layer of an oxide on a metal substrate, with the method successively comprising:

/a/ preparing a non-aqueous solution of a precursor of the oxide;

/b/ depositing the non-aqueous solution on one surface at least of the metal substrate in order to cover said surface of the metal substrate at least partially with a film comprising the precursor of the oxide; and /c/ carrying out a hydrolysis-condensation of the precursor of the oxide by exposing the film to a humid atmosphere in order to form an oxide network in the film;

/d/ carrying out a treatment for stabilizing the film on the surface of the substrate;

/e/ carrying out a heat treatment of the surface of the metal substrate in order to crystallize the network of oxide and form the anti-corrosion coating;

wherein the step /b/ is carried out by putting the surface into contact with a predetermined volume of solution confined at least partially by a sealed membrane, the sealed membrane being able to slide via translation along the surface, with a controlled displacement of the sealed membrane allowing for the formation of a controlled thickness of film on the surface.

2. The method according to claim 1, wherein the steps /b/ to /d/ are repeated in order to deposit more than one layer on the metal substrate.

3. The method according to claim 1, wherein the treatment for stabilizing comprises exposing the film to a flow of gas brought to a temperature greater than an ambient temperature and less than 200° C.

4. The method according to claim 1, wherein the treatment for stabilizing comprises exposing the film to ultraviolet radiation.

5. The method according to claim 1, wherein the treatment for stabilizing is chosen from a treatment of the film assisted by microwaves and a treatment of the film by induction, at a temperature greater than an ambient temperature and less than 200° C.

6. The method according to claim 1, wherein the precursor of the oxide is chosen from a precursor of titanium, a precursor of zirconium, a precursor of chromium, a precursor of yttrium, a precursor of cerium and a precursor of aluminum.

7. The method according to claim 1, wherein the precursor of the oxide is chosen from: titanium ethoxide, titanium n-propoxide, titanium s-butoxide, titanium n-butoxide, titanium t-butoxide, titanium isobutoxide, titanium isopropoxide, tetrabutyl orthotitanate, tetra-tert-butyl orthotitanate, poly(dibutyltitanate), zirconium n-propoxide, zirconium n-butoxide, zirconium t-butoxide, zirconium ethoxide, zirconium 2-methoxymethyl-2-propoxide, zirconium 2-methyl-2-butoxide, zirconium isopropoxide, yttrium isopropoxide, yttrium n-butoxide, titanium methacrylate triisopropoxide, titanium diisopropoxide bis(tetramethylheptanedionate), titanium 2,4-pentanedionate, diisopropoxy-bis (ethylacetoacetato)titanate, titanium di-n-butoxide (bis-2,4-pentanedionate), titanium 2-ethylhexoxide, titanium oxide bis(acetylacetonate), bis(2,2,6,6-tetramethyl-3,5-heptanedionato)oxotitane, titanium bis(ammonium lactato)dihydroxide, zirconium bis(diethyl citrato)dipropoxide, zirconyl propionate, chromium acetate, cerium t-butoxide, cerium methoxyethoxide, aluminum s-butoxide, aluminum n-butoxide, aluminum t-butoxide, yttrium isopropoxide, yttrium butoxide, yttrium acetylacetonate, yttrium 2-methoxyethoxide, aluminum isopropoxide, aluminum ethoxide, aluminum tri-sec-butoxide, aluminum tert-butoxide, cerium isopropoxide.

8. The method according to claim 1, wherein the solution of the precursor of the oxide comprises for one mole of the precursor of the oxide, 0 to 2 moles of complexing agent and 10 to 50 moles of ethanol.

9. The method according to claim 8, wherein the solution of the precursor of the oxide further comprises for one mole of the precursor of the oxide up to 0.2 mole of a surfactant.

10. The method according to claim 1, wherein the step /b/ is implemented by a technique chosen from: a dip-withdraw of the surface in the solution, the withdraw being carried out at a speed between 0.5 mm/s and 20 mm/s; a spraying of the solution onto the surface with a controlled spray flow rate and a controlled relative displacement speed of a sprayer with respect to the surface; an evaporation of the solution in an enclosure containing the surface and under controlled temperature and pressure.

11. The method according to claim 1, wherein the step /b/ is carried out by putting the surface into contact with a spongy element impregnated with the solution and diffusing the solution via capillarity on the surface.

12. The method according to claim 1, wherein the surface is an inside surface of a cylindrical substrate, with the sealed membrane being mobile in translation along an axis of the cylindrical substrate.

13. The method according to claim 1, wherein the steps /b/ to /e/ are implemented on a production line carrying out a relative displacement of the metal substrate with respect to animated modules arranged to carry out the depositing of the solution on the surface, the exposing of the film to a humid atmosphere, the exposing of the film to a treatment for stabilizing and the exposing of the film to a heat treatment.

14. The method according to claim 1, wherein the heat treatment is carried out at a temperature between 300° C. and 500° C.

* * * * *